US007174605B1

(12) United States Patent
Nawrocki

(10) Patent No.: US 7,174,605 B1
(45) Date of Patent: Feb. 13, 2007

(54) HANDLES FOR ATTACHMENT TO WIRED PRODUCTS

(75) Inventor: John Richard Nawrocki, Ocala, FL (US)

(73) Assignee: Clairson, Inc., Newark, DE (US)

( * ) Notice: Subject to any disclaimer, the term of this patent is extended or adjusted under 35 U.S.C. 154(b) by 0 days.

(21) Appl. No.: 11/253,155

(22) Filed: Oct. 18, 2005

(51) Int. Cl.
*A45C 13/22* (2006.01)

(52) U.S. Cl. ..... 16/428; 16/422; 383/15; 383/25

(58) Field of Classification Search ..... 16/428, 16/422, 424, 425; D8/300, 312, 321; 220/759, 220/753, 755; 383/15, 25; 294/171; 24/136 R, 24/115 M, 573.09
See application file for complete search history.

(56) References Cited

U.S. PATENT DOCUMENTS

| | | | | | |
|---|---|---|---|---|---|
| 202,556 | A * | 4/1878 | Lane | 403/215 |
| 499,481 | A * | 6/1893 | Swegles | 294/171 |
| 2,319,147 | A | 5/1943 | Mason | |
| 2,371,639 | A | 3/1945 | Mason | |
| 2,398,436 | A | 4/1946 | Mason | |
| 2,488,309 | A * | 11/1949 | Mason | 220/759 |
| 3,692,155 | A * | 9/1972 | Laurita | 16/114.1 |
| 4,313,243 | A * | 2/1982 | Childress et al. | 24/136 K |
| 4,364,150 | A * | 12/1982 | Remington | 16/409 |
| 5,287,991 | A * | 2/1994 | Koda et al. | 220/769 |
| 5,649,340 | A * | 7/1997 | Ida | 24/115 G |
| 6,167,592 | B1 * | 1/2001 | Tsai | 16/411 |
| 6,185,786 | B1 | 2/2001 | Garcia | |
| 6,334,240 | B1 * | 1/2002 | Li | 24/115 G |
| 6,336,255 | B1 * | 1/2002 | Gallup | 16/425 |
| 6,405,409 | B1 | 6/2002 | Zirella | |
| 6,625,849 | B1 * | 9/2003 | Womack et al. | 24/115 M |
| 6,658,698 | B2 * | 12/2003 | Chen | 16/114.1 |
| 6,817,066 | B1 | 11/2004 | Williams et al. | |

* cited by examiner

*Primary Examiner*—Chuck Y. Mah
*Assistant Examiner*—Michael J. Kyle
(74) *Attorney, Agent, or Firm*—Harness, Dickey & Pierce, P.L.C.

(57) ABSTRACT

Various aspects of the invention provide handles that can be attached to wire-like members. In one exemplary embodiment, a handle generally includes a handle portion, a retaining member, and a key member. The handle portion has a channel and an aperture extending from at least one outer surface of the handle portion into the channel. The channel is configured to receive at least a portion of a wire-like member therein. The retaining member is configured to be received within the channel. The retaining member has an aperture. The key member is configured to be engaged within the handle portion's aperture and the retaining member's aperture. Engagement of the key member within the retaining member's aperture can inhibit the egress of the retaining member from the channel to operatively trap at least a portion of a wire-like member within the channel, and, thereby, attach the handle portion to the wire-like member.

28 Claims, 12 Drawing Sheets

HANDLES FOR ATTACHMENT TO WIRED PRODUCTS

FIELD

The present invention relates to handles for attachment to wired products.

BACKGROUND

The statements in this background section merely provide background information related to the present disclosure and may not constitute prior art.

Wire baskets or storage bins are commonly used for storing and carrying items. Wire baskets may be constructed to from transversely and longitudinally extending wires (e.g., formed steel wires). Some of the basket's wires may be configured to form wire handles, such as generally U-shaped handles formed by two longitudinally extending wire support members that are configured as a single wire. These wire handles may make it easier for the user to carry the wire basket. But the wire handles can also be a source of discomfort to the user especially when carrying a wire basket loaded with heavy items due to the wire handle pressing into the user's hands.

SUMMARY

According to various aspects of the invention, there are provided various exemplary embodiments of handles that can be attached to wire-like members, such as wire members of a shelf, basket, bin, sliding tray, etc. In one exemplary embodiment, a handle generally includes a handle portion, a retaining member, and a key member. The handle portion has a channel and an aperture extending from at least one outer surface of the handle portion into the channel. The channel is configured to receive at least a portion of a wire-like member therein. The retaining member is configured to be received within the channel. The retaining member has an aperture. The key member is configured to be engaged within the handle portion's aperture and the retaining member's aperture. In various embodiments, engagement of the key member within the retaining member's aperture can inhibit the egress of the retaining member from the channel to operatively trap at least a portion of a wire-like member within the channel, and, thereby, attach the handle portion to the wire-like member.

According to another aspect of the invention, various embodiments of handle assemblies are provided in combination with a wire basket having a plurality of wire members. In one exemplary embodiment, a handle assembly generally includes a handle body, a cap, and a key. The handle body has a channel disposed longitudinally along substantially the entire length of the handle body between opposite end portions of the handle body. The handle body also includes an opening therethrough and extending into the channel. The channel is configured to receive at least a portion of one of the wire members of the wire basket substantially along a longitudinal centerline of the handle body. The cap is configured to be received within the channel. The cap has an aperture substantially transverse to the handle body's longitudinal centerline. The key is configured to be engaged within the handle body's opening and the cap's aperture. In various embodiments, engagement of the key within the cap's aperture inhibits the egress of the cap from the channel to operatively trap the portion of the wire member portion within the channel, and, thereby, attach the handle assembly to the wire basket.

According to further aspects, the invention provides various embodiments of handle bodies. In one exemplary embodiment, a handle body generally includes a first end portion and a second end portion. The handle body also includes first, second and third slots. The first slot longitudinally extends along the first end portion. The second slot longitudinally extends along the second end portion on a side portion of the handle body generally opposite that of the first slot. The third slot extends between the first and second end portions. The third slot generally transversely intersects the first and second slots. Collectively, the first, second and third slots define a longitudinal opening configured to receive a portion of a wire-like member therein. In various embodiments, the slots allow the handle body to be attached to a wire-like member by positioning a portion of the wire-like member within the third slot and then rotating the handle body relative to the wire-like member to position the portion of the wire-like member within the longitudinal opening collectively defined by the slots.

Further aspects and features of the present invention will become apparent from the detailed description provided hereinafter. In addition, any one or more aspects of the invention may be implemented individually or in any combination with any one or more of the other aspects of the invention. It should be understood that the detailed description and specific examples, while indicating exemplary embodiments of the invention, are intended for purposes of illustration only and are not intended to limit the scope of the invention.

DRAWINGS

The drawings described herein are for illustration purposes only and are not intended to limit the scope of the present disclosure in any way.

DETAILED DESCRIPTION

Figure 1:
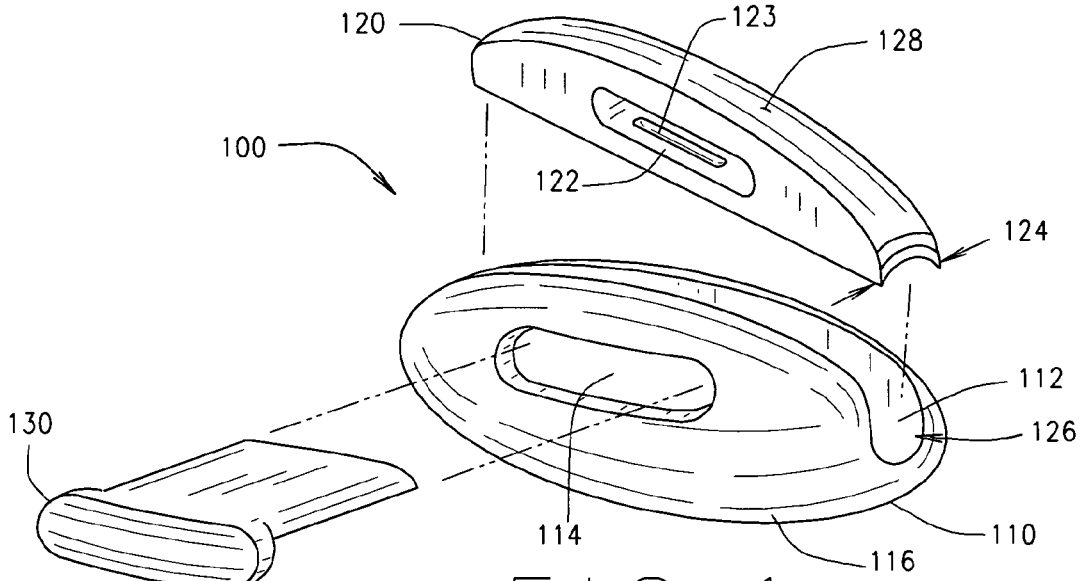
FIG. 1 is an exploded perspective view of a three-piece handle that can be attached to a wire according to one exemplary embodiment of the invention.

The following description is merely exemplary in nature and is in no way intended to limit the present disclosure, application, or uses.

According to various aspects of the invention, there are provided various exemplary embodiments of handles that can be attached to wire-like members, such as wire members of a shelf, basket, bin, sliding tray, etc. In one exemplary embodiment, a handle generally includes a handle portion, a retaining member, and a key member. The handle portion has a channel and an aperture extending from at least one outer surface of the handle portion into the channel. The channel is configured to receive at least a portion of a wire-like member therein. The retaining member is configured to be received within the channel. The retaining member has an aperture. The key member is configured to be engaged within the handle portion's aperture and the retaining member's aperture. In various embodiments, engagement of the key member within the retaining member's aperture can inhibit the egress of the retaining member from the channel to operatively trap at least a portion of a wire-like member within the channel, and, thereby, attach the handle portion to the wire-like member.

In some embodiments, at least one of the retaining member and the key member may include at least one catch (e.g., rib, projection, protrusion, ridge, detent, dimple, etc.). The other of the retaining member and the key member may include at least one opening (e.g., recess, void, cavity, slot, groove, hole, depression, etc). This opening can be configured to engagingly receive the catch when the key member is engaged within the retaining member's aperture. Accordingly, the engagement of the catch within the opening can inhibit the egress of the key member from within the retaining member's aperture.

According to another aspect of the invention, various embodiments of handle assemblies are provided in combination with a wire product (e.g., wire basket, etc.) having a plurality of wire members. In one exemplary embodiment, a handle assembly generally includes a handle body, a cap, and a key. The handle body has a channel disposed longitudinally along substantially the entire length of the handle body between opposite end portions of the handle body. The handle body also includes an opening therethrough and extending into the channel. The channel is configured to receive at least a portion of one of the wire members of the wire basket substantially along a longitudinal centerline of the handle body. The cap is configured to be received within the channel. The cap has an aperture substantially transverse to the handle body's longitudinal centerline. The key is configured to be engaged within the handle body's opening and the cap's aperture. In various embodiments, engagement of the key within the cap's aperture inhibits the egress of the cap from the channel to operatively trap the portion of the wire member portion within the channel, and, thereby, attach the handle assembly to the wire product (e.g., wire basket, ventilated shelves, wire bins, sliding storage devices (e.g., sliding shelves, trays, etc.), kitchen cabinetry, garage cabinetry, bathroom cabinetry, among other devices).

In some embodiments, at least one of the cap and the key may include at least one catch (e.g., rib, projection, protrusion, ridge, detent, dimple, etc.). The other of the cap and the key may include at least one opening (e.g., recess, void, cavity, slot, groove, hole, depression, etc). This opening can be configured to engagingly receive the catch when the key is engaged within the cap's aperture. Accordingly, the engagement of the catch within the opening can inhibit the egress of the key from within the cap's aperture.

According to further aspects, the invention provides various embodiments of handle bodies. In one exemplary embodiment, a handle body generally includes a first end portion and a second end portion. The handle body also includes first, second and third slots. The first slot longitudinally extends along the first end portion. The second slot longitudinally extends along the second end portion on a side portion of the handle body generally opposite that of the first slot. The third slot extends between the first and second end portions. The third slot generally transversely intersects the first and second slots. Collectively, the first, second and third slots define a longitudinal opening configured to receive a portion of a wire-like member therein. In various embodiments, the slots allow the handle body to be attached to a wire-like member by positioning a portion of the wire-like member within the third slot and then rotating the handle body relative to the wire-like member to position the portion of the wire-like member within the longitudinal opening collectively defined by the slots.

Other aspects include products (e.g., wire basket, wire ventilated shelves, wire bins, sliding storage devices, sliding shelves, trays, kitchen cabinetry, garage cabinetry, bathroom cabinetry, pots, buckets, pans, among other devices). having one or more of such handles, methods of using such handles, and methods of making such handles. In addition, any one or more aspects of the invention may be implemented individually or in any combination with any one or more of the other aspects of the invention. For example, one embodiment of the invention may include a wire basket (or other product) having a three-piece handle and a one-piece handle.

One exemplary embodiment includes a three-piece keyed handle having a handle body, a cap or retainer, and a key. When assembled around a wire, these three components form a handle. In various embodiments, the assembled handle has an external appearance resembling a cigar and is about as wide as the average adult hand. The handle body can include a slot or channel extending lengthwise or longitudinally along the handle body. The cap can be configured to be positioned within the handle body's slot. The handle body and cap can be configured such that the cap and slot collectively encapsulate and operatively trap a wire within the slot. The cap can also be configured such that when positioned within the handle body's slot, the assembled handle has a substantially seamless appearance and is snugly fitted about the wire. The key can be configured to fit into a passage or opening through the assembled handle body and cap. When positioned within the passage, the key inhibits disassembly or removal of the cap from the handle body's slot. In various embodiments, the handle components are produced of a plastic or composite material, although other suitable materials can also be used. In addition, the handle components can be configured to resemble or to take on visual similarities to different materials, such as carbon fiber, metals, woods, etc.

Another exemplary embodiment includes a single-piece handle having a generally oval shaped body with a lateral or cross-wise slot and a lengthwise or longitudinal slot that intersects the lateral slot. With these slots, the single-piece handle can be straddled to a wire (or other member) with the wire positioned within the lateral slot. The handle can then be rotated approximately ninety degrees to align the handle lengthwise with the mating wire, thus positioning the wire within the longitudinal slot. This rotation can also cause the handle to be snapped into position by way of one or more camming surfaces adjacent or within the longitudinal slot. In various embodiments, this camming feature can help retain the handle to the wire, but not unduly limit it from forcible removal such that the handle can be readily removed and added to product without the use of tools.

Various embodiments include a single-piece handle having an external appearance resembling a cigar and about as wide as the average adult hand. In various embodiments, a single-piece handle is produced from plastics, composite materials, silicon, although other suitable materials can also be used. In some embodiments, a single-piece handle can be configured to resemble or to take on visual similarities to different materials, such as carbon fiber, metals, woods, etc.

Various embodiments provide a single-piece handle that can be easily added or removed and located to another item in need of a handle. Some embodiments provide a single-piece handle manufactured of a material that is very stable in temperature extremes, such as silicon. In such embodiments, the single-piece handle can be utilized as a grip for hot or cold items.

Accordingly, various aspects of the invention relate to handles and the designs thereof that can be relatively easily, quickly assembled to a wire product without using any tools. Various handle embodiments can provide a wire basket (e.g., welded, finished, painted, and/or chrome wire basket, etc.) or other wire products with a higher level of comfort, utility, and identity.

Referring now to FIG. 1, there is shown one exemplary embodiment of a handle 100 according to the principles of the present invention. As shown in FIG. 1, the handle comprises a handle body or portion 110, a retaining member 120, and a key member 130. These handle components 110, 120, 130 are configured to be attached to a portion of a wire-like member, such as a wire handle portion of a wire basket, wire bin, wire ventilated shelf, slide-type shelf or tray, etc.

The handle body 110 has a channel 112 generally centered along a side of the handle portion 110. The channel 112 extends longitudinally along the length of the handle portion 110. The channel 112 generally extends through the interior of the handle portion 110. The channel 112 is configured to receive a portion of a wire-like member therein generally along the axial or longitudinal centerline of the handle portion 110.

The handle portion 110 has an outer surface that extends around at least about two hundred seventy degrees of the axial centerline of the handle portion 110. This outer surface essentially begins at one edge or lip portion of the channel 112 and then extends around to the channel's other or opposite edge portion. Accordingly, in this embodiment, the outer surface of the handle portion 110 provides a generally continuous and seamless gripping surface substantially without any breaks or seams that could otherwise irritate or cause discomfort to the user and/or provide a less aesthetically-pleasing handle.

The handle portion 110 also includes an aperture 114 in the handle portion 110 that extends transversely through the channel 112. In some embodiments, the handle portion 110 comprises a lengthwise channel 112 configured (e.g., shaped, sized, ribbed, etc.) to frictionally engage a wire positioned therein even prior to assembling the retaining member 120. For example, the sidewalls forming channel 112 may comprise one or more relatively narrow ribs configured to frictionally engage the wire within the channel 112. These ribs may be compressed as the wire is seated within the channel 112. In such embodiments, the retaining member 120 and the handle body 110 would not have to be compressed over a wire during assembly to provide a handle assembly in frictional engagement with a wire. This, in turn, can help simplify assembly in that the retaining member 120 and the handle body 110 can be put together and the key member 130 positioned through the apertures 114 and 122 without the user having to also hold the parts together in compression against a wire.

Figure 2:
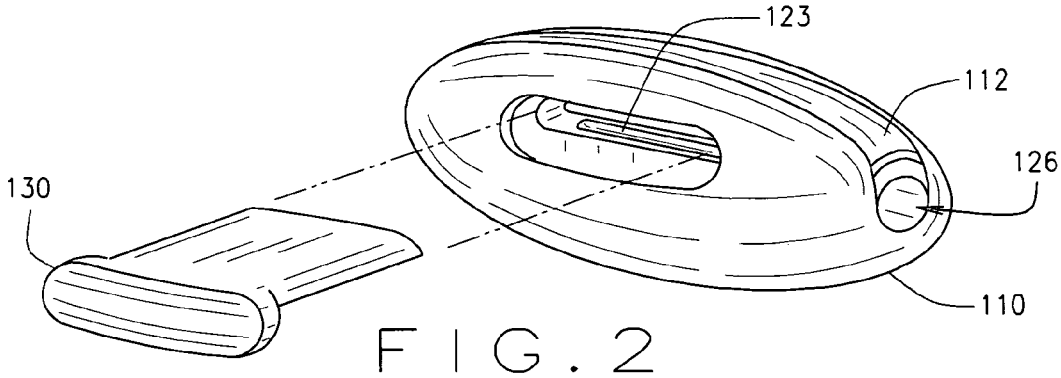
FIG. 2 is a perspective view of the three-piece handle shown in FIG. 1 after two of the three handle pieces have been assembled.

The retaining member 120 is configured (e.g., shaped, sized, etc.) to be received within the channel 112 as shown in FIG. 2. When received within the channel 112, the retaining member 120 can operatively trap a portion of a wire within the channel 112. The retaining member 120 also includes the aperture 122 extending generally transversely therethrough. The aperture 122 is configured (e.g., shaped, sized, positioned, etc.) to substantially align with the aperture 114 in the handle portion 110 when the retaining member 120 is within the channel 112.

In some embodiments, the retaining member's aperture 122 is configured such that is aligns with the handle body's aperture 114 without having to compress the retaining member 120 against the wire portion within the channel 112. The retaining member 120 can have a width 124 that allows the retaining member 120 to be relatively easily positioned within the channel 112. The retaining member 120 may further also include a curved inner surface with a curvature or profile that cooperates with the channel's curved bottom surface to form or define a passage 126 having a generally circular or round transverse profile. As shown, the channel 112 includes a generally U-shaped transverse profile. Alternatively, the channel 112 and the retaining member 120 can have different cross-sectional shapes.

The retaining member 120 also includes a curved outer surface 128 that cooperates and substantially aligns with the outer contour 116 of the handle body 110 when the retaining member 120 is within the channel 112. This provides the handle 100 with a substantially continuous smooth outer surface having a substantially seamless appearance.

Figure 3:
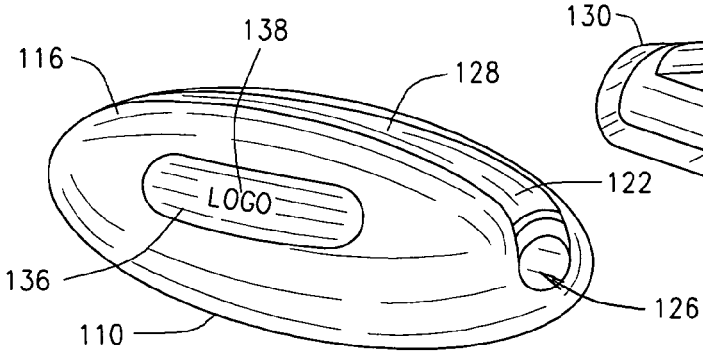
FIG. 3 is a perspective view of the three-piece handle shown in FIGS. 1 and 2 after all three handle pieces have been assembled.
Figure 4:
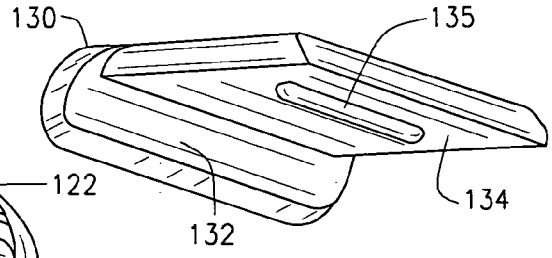
FIG. 4 is a back perspective view of the key member shown in FIG. 1.
Figure 5:
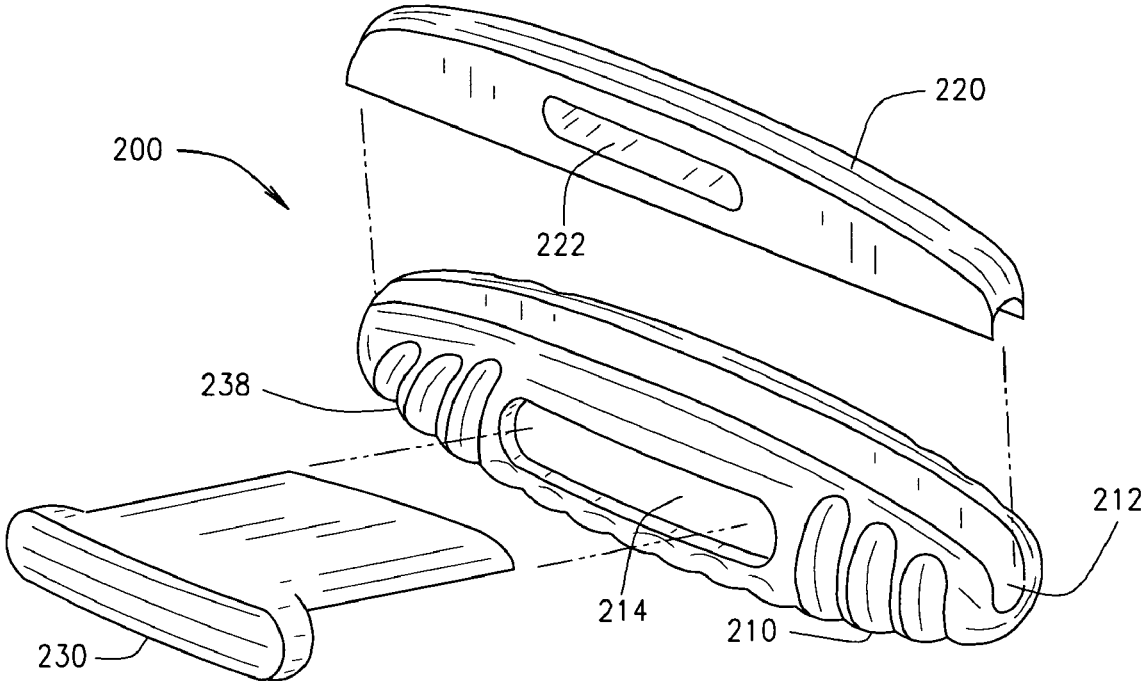
FIG. 5 is an exploded perspective view of a three-piece handle that can be attached to a wire according to another exemplary embodiment of the invention.

The handle 100 also includes the key member 130. As shown in FIG. 4, the key member 130 generally includes a portion 132 and a protruding member or protrusion 134. The protrusion 134 is configured to be received within the aperture 114 and 122 of the respective handle portion 110 and retaining member 120, as shown in FIG. 3.

The protrusion 134 is preferably configured to be slidably inserted through the handle body's aperture 114 and the retainer's aperture 122 to relatively secure the retaining member 120 within the channel 112 of the handle portion 110. In some embodiments, the engagement of the key 130 with the apertures 114 and 122 inhibits sliding movement of the retaining member 120 relative to the handle portion 110.

Engagement of the key member 130 within the retaining member's aperture 122 inhibits the egress of the retaining member 120 from the channel 112 to operatively trap at least a portion of a wire-like member within the channel 112, and, thereby, attach the handle 100 to the wire-like member.

In some embodiments, at least one of the retaining member and the key member may include at least one catch (e.g., rib, projection, protrusion, ridge, detent, dimple, etc.). The other of the retaining member and the key member may include at least one opening (e.g., recess, void, cavity, slot, groove, hole, depression, etc). This opening can be configured to engagingly receive the catch when the key member is engaged within the retaining member's aperture. Accordingly, the engagement of the catch within the opening can inhibit the egress of the key member from within the retaining member's aperture.

In the particular illustrated embodiment, the key member 130 includes a rib or ridge 135 (FIG. 4), and the retaining member 120 includes the opening 123 (FIGS. 1 and 2). The opening 123 extends from the retaining member's aperture 122 downwardly and partially through a portion of the retaining member 120. In other embodiments, the opening may extend completely through the portion of the retaining member (see, for example, the opening 423 of retaining member 420 in FIGS. 14 through 16).

With continued reference to FIGS. 1 through 4, the opening 123 is configured to engagingly receive the rib 135 when the key member 130 is engaged within the retaining member's aperture 122. Engagement of the rib 135 within the opening 123 inhibits the egress of the key member 130 from within the retaining member's aperture 122. Alternative embodiments include the key member having the catch, and the retaining member having the opening for engagingly receiving the catch. Further embodiments include the key member and retaining member having male and female catch features (e.g., rib and opening, etc.), but which are located at different positions. Yet other embodiments do not include male and female catch features.

As shown in FIG. 3, the key member 130 may further comprise an outer surface 136 that includes a logo or indicia 138 thereon. The outer surface 136 may include an integrally molded indicia or logo thereon, or may simply provide an area that is conducive for printing on or mounting a label thereto. The key member 130 may further include an outer portion that includes a recessed hollow for purposes of reduced material and improved manufacturability (see, for example, key member 230 in FIG. 9).

Accordingly, various embodiments provide handle assemblies that may be relatively quickly and easily assembled onto or disassembled from a portion of wire, without requiring the use of any tools. In some embodiments, the aperture 114 extends completely through the handle body 110, such that the key member 130 can be relatively easily removed by applying a force to the opposite side (the back side opposite the surface 138 in FIG. 3) of the key member 130, so as to overcome any resistance to removal and slidably release the protrusion 134 from the apertures 114 and 122 in the handle body 110 and retaining member 120. In such embodiments, the handle 100 may also be easily removed without the use of tools, to thereby allow for convenient removal and replacement of the handle 100.

FIGS. 5 through 10 illustrate another exemplary embodiment of a handle 200. As shown, the handle 200 includes a handle portion 210, a retaining member 220, and a key member 230. The handle portion 210 includes a plurality of grooves 238 extending radially around the outer contour surface 216 of the handle portion 210 to provide for a gripping surface. A plurality of raised ridges may alternatively be provided to achieve a gripping surface as well.

Figure 10:
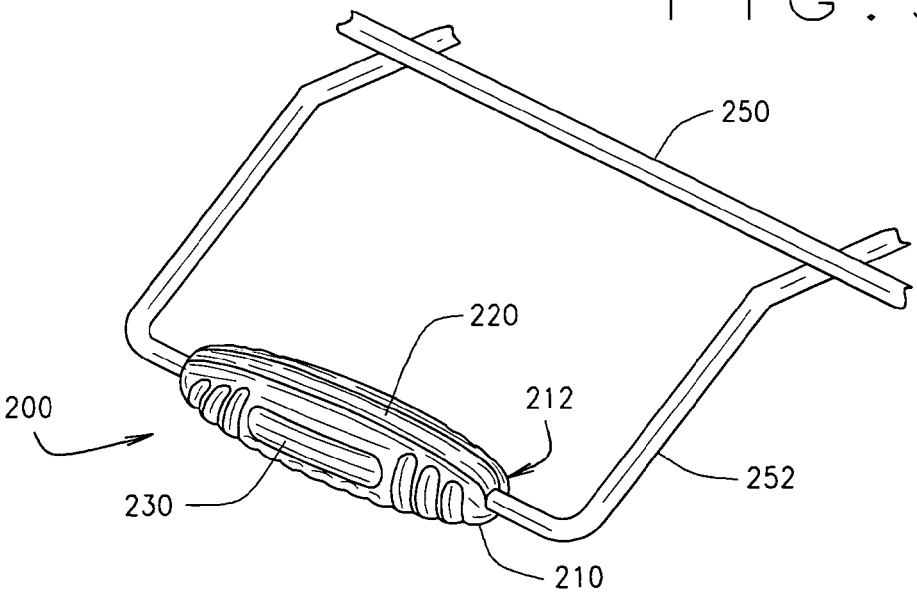
FIG. 10 is a perspective view illustrating the handle shown in FIG. 5 assembled to a wire.

The handle portion 210 has a longitudinally extending channel 212, and an aperture 214 extending transversely through the channel 212. As shown in FIG. 10, the handle assembly 200 is attached to a wire member 252 of a device 250, with a portion of the wire member 252 within the channel 212 generally along a longitudinal centerline of the handle portion 210.

The handle assembly 200 further comprises a retaining member 220 configured to be received within the channel 212 for operatively trapping the portion of the wire member 252 within the channel 212. The retaining member 220 has an aperture 222 therethrough that aligns with the aperture 214 in the handle body 210 when the retaining member 220 is within the channel 212. In some embodiments, the retainer's aperture 222 is configured (e.g., shaped, sized, positioned, etc.) to align with the handle body's aperture 214 without having to compress or force the retaining member 220 against the portion of the wire member 252 within the channel 212.

Figure 6:
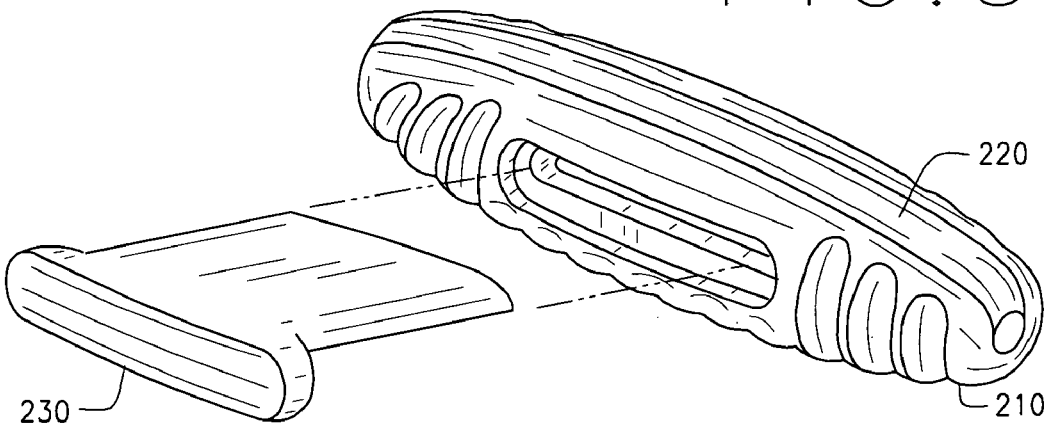
FIG. 6 is a perspective view of the three-piece handle shown in FIG. 5 after two of the three handle pieces have been assembled.
Figure 7:
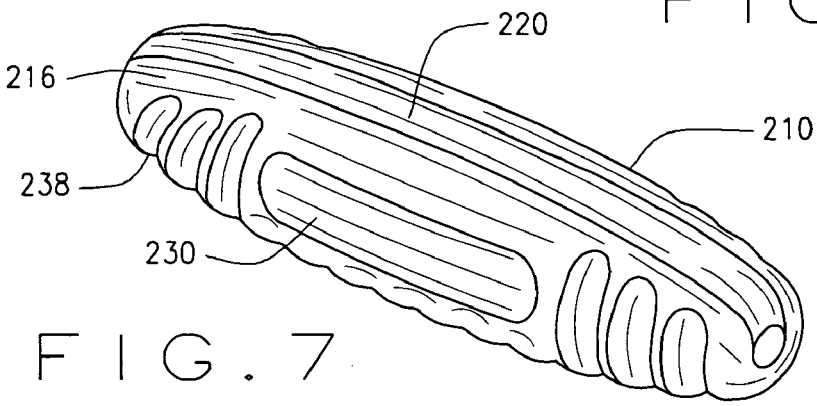
FIG. 7 is a perspective view of the three-piece handle shown in FIGS. 5 and 6 after all three handle pieces have been assembled.
Figure 8:
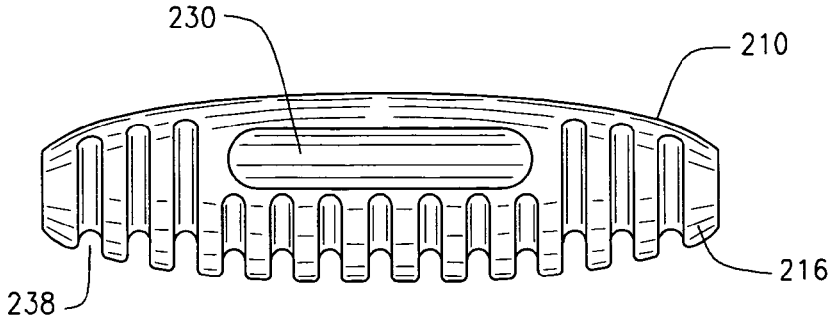
FIG. 8 is a side view of the assembled handle shown in FIG. 7.
Figure 9:
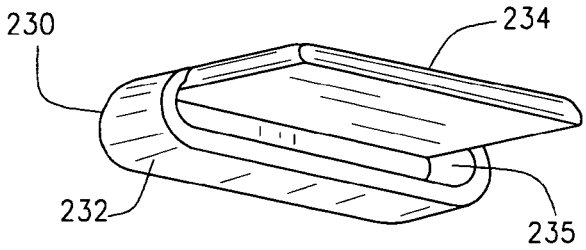
FIG. 9 is a back perspective view of the key member shown in FIG. 5.

As shown in FIG. 9, the key member 230 generally includes a portion 232 and a protruding member or protrusion 234. The protrusion 234 is configured to be received within the aperture 214 and 222 of the respective handle portion 210 and retaining member 220, as shown in FIGS. 6 and 7.

The protrusion 234 is preferably configured to be slidably positioned through the handle body's aperture 214 and the retainer's aperture 222 to relatively secure the retaining member 220 within the channel 212 of the handle portion 210. In some embodiments, the engagement of the key 230 with the apertures 214 and 222 inhibits sliding movement of the retaining member 220 relative to the handle portion 210.

Engagement of the key member 230 within the retaining member's aperture 222 inhibits the egress of the retaining member 220 from the channel 212 to operatively trap at least a portion of a wire-like member 252 within the channel 212, and, thereby, attach the handle 200 to the wire-like member 252. In some embodiments, the outer surface portion of the key member 130 may include at least one detent adapted to inhibit removal of the key member 230 from the handle body's recess 214, for example, when the key member 230 is fully inserted.

The key member 230 may further comprise an outer surface having a logo or indicia thereon. The outer surface may include an integrally molded indicia or logo thereon, or may simply provide an area that is conducive for printing on or mounting an adhesive label thereto. As shown in FIG. 9, the key member 230 may further include a recessed hollow 235 for purposes of reduced material and improved manufacturability (see, for example, key member 230 in FIG. 9).

In some embodiments, at least one of the retaining member and the key member may include at least one catch (e.g., rib, projection, protrusion, ridge, detent, dimple, etc.). The other of the retaining member and the key member may include at least one opening (e.g., recess, void, cavity, slot, groove, hole, depression, etc). This opening can be configured to engagingly receive the catch when the key member is engaged within the retaining member's aperture. Accordingly, the engagement of the catch within the opening can inhibit the egress of the key member from within the retaining member's aperture. Alternative embodiments do not include male and female catch features, such as a rib and opening.

Figure 11:
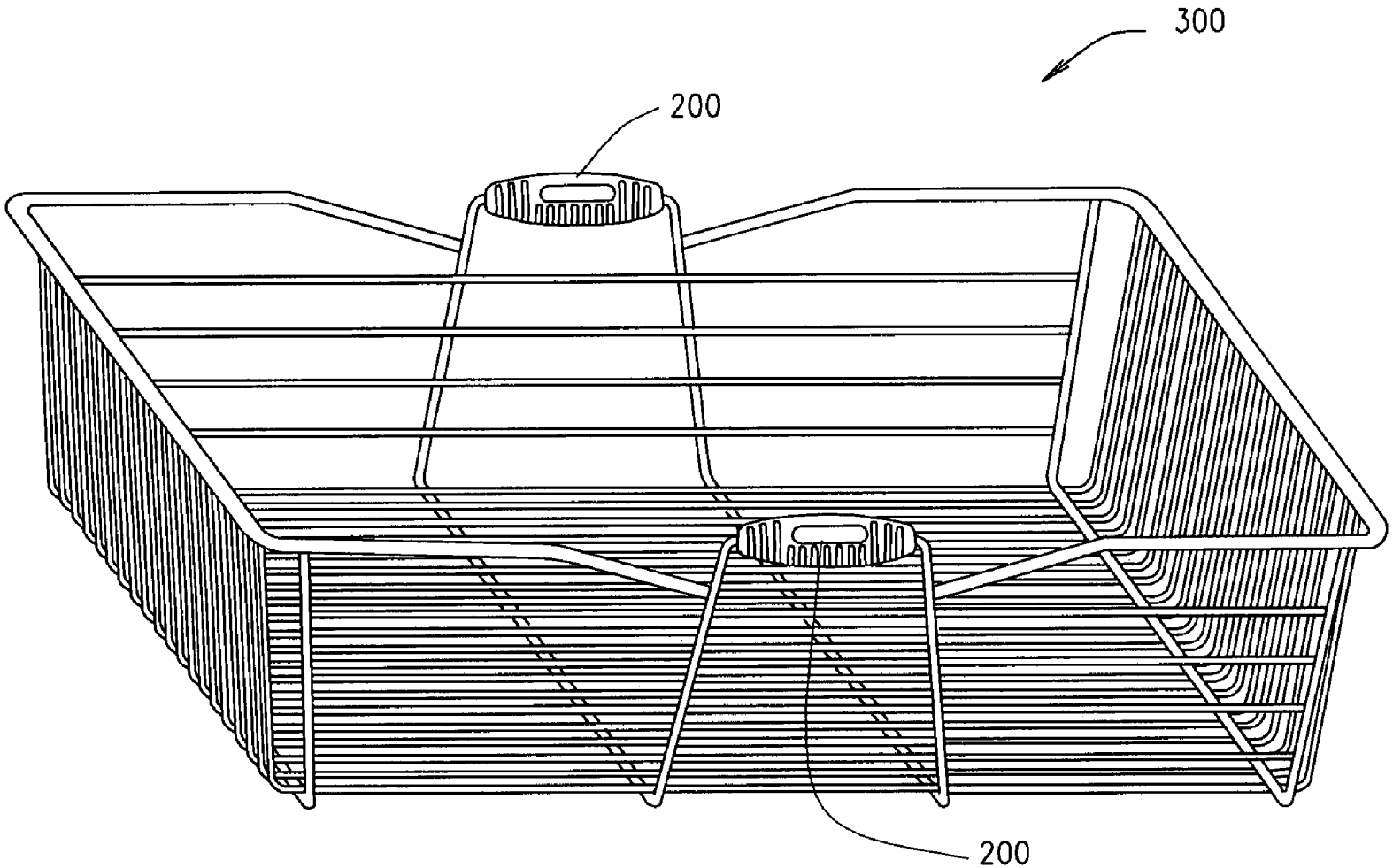
FIG. 11 is a perspective view of a wire basket including two of the handles shown in FIGS. 5 through 10 according to another exemplary embodiment of the invention.
Figure 12:
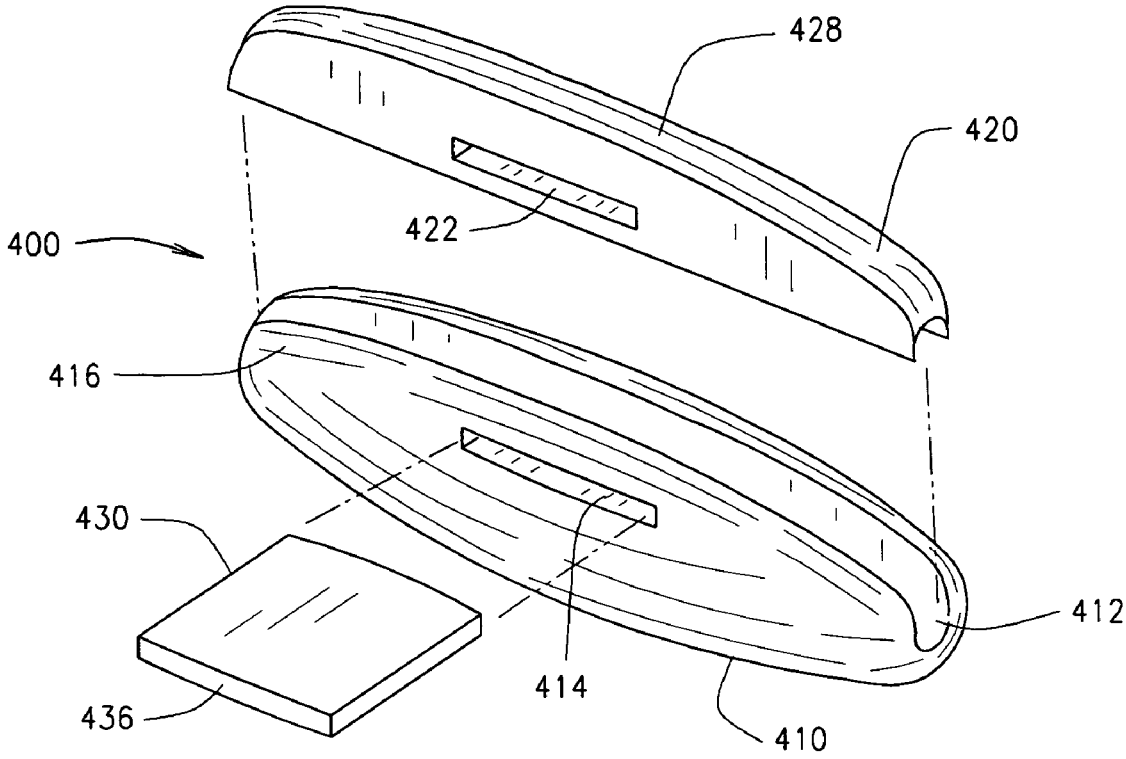
FIG. 12 is an exploded perspective view of a three-piece handle that can be attached to a wire according to another exemplary embodiment of the invention.
Figure 13:
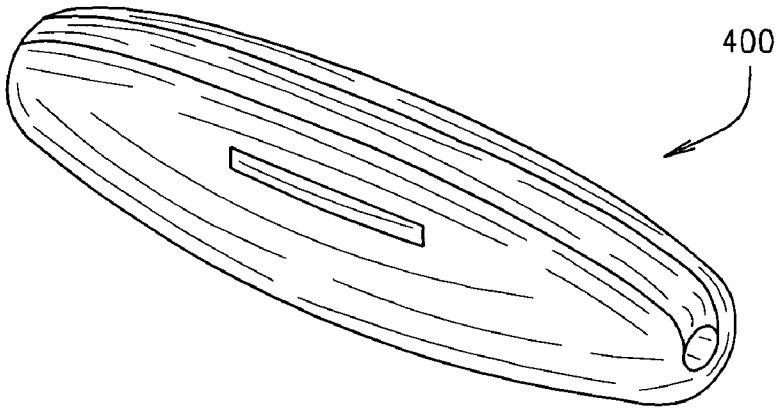
FIG. 13 is a perspective view of the three-piece handle shown in FIG. 12 after all three pieces of the handle have been assembled.

FIG. 11 illustrates an exemplary wire basket 300 having two handles 200. The particular basket shown in FIG. 11 is for purposes of illustration only as various aspects of the invention can be used with a wide range of wires, wire-like members, and devices having such wires or wire-like members, including wire ventilated shelves, bins, baskets, sliding storage devices (e.g., sliding shelves, trays, etc.), kitchen cabinetry, garage cabinetry, bathroom cabinetry, pots, pans, buckets, among other containers and storage devices. Accordingly, the specific references to wire basket herein should not be construed as limiting the scope of the invention to only one specific form/type of application. By way of example, one or more handles may be used in connection with a slide-type of installation in which the handles allow the user to more comfortably pull out the sliding device, such as in kitchen, garage, and/or bathroom cabinetry.

FIGS. 12 through 16 illustrate another embodiment of a handle 400 embodying one or more aspects of the present invention. As shown, the handle 400 includes a handle portion 410, a cap or retaining member 420, and a key member 430. The handle portion 410 has a channel 412, and an aperture 414 extending transversely through the channel 412.

The retaining member 420 is adapted to be received within the channel 412. When the retaining member 420 is received within the channel 412, the retaining member 420 can operatively trap a portion of a wire member within the channel 412.

The retaining member 420 also includes an aperture 422 therethrough. The aperture 422 is configured to substantially align with the aperture 414 in the handle portion 410 when the retaining member 420 is received within the channel 412 of the handle portion 410. In some embodiments, the retaining members' aperture 422 can align with the aperture 414 in the handle body portion 410 without having to compress the retaining member 420 against a portion of a wire member within the channel 412.

The retaining member 420 further comprises an outer surface 428. In some embodiments, the outer surface 428 is configured (e.g., shaped, sized, etc.) such that it substantially aligns with the outer contour 416 of the handle portion 410 when the retaining member 420 is secured within the channel 412.

In the illustrated embodiment of FIGS. 12 through 16, the key member 430 is generally rectangular in shape for being received within the corresponding generally rectangular apertures 414 in the handle portion 410 and the aperture 422 in the retaining portion 420. Alternatively, other shapes and configuration can be used for the key member and apertures.

In various embodiments, the key member 430 is configured to be slidably inserted through the aperture 414 in the handle portion 410 and the aperture 422 in the retaining member 420 so as to secure the retaining member 420 within the channel 412 in the handle portion 410 in a manner that inhibits sliding movement of the retaining member 420 relative to the handle portion 410. The key member 430 when inserted into the apertures 414 and 422 also retains the retaining member 420 and the handle portion 410 over a portion of wire that is received within the channel 412. The key member 430 comprises outer edge surfaces 436 that align with the outer contour 416 of the handle portion 410, and may further include indicia thereon.

In some embodiments, at least one of the retaining member and the key member may include at least one catch (e.g., rib, projection, protrusion, ridge, detent, dimple, etc.). The other of the retaining member and the key member may include at least one opening (e.g., recess, void, cavity, slot, groove, hole, depression, etc). This opening can be configured to engagingly receive the catch when the key member is engaged within the retaining member's aperture. Accordingly, the engagement of the catch within the opening can inhibit the egress of the key member from within the retaining member's aperture.

Figure 14:
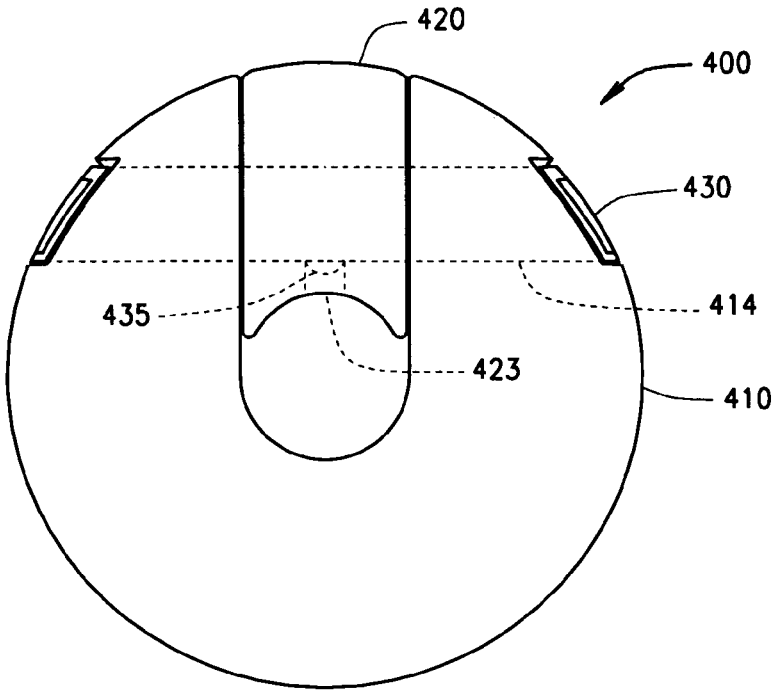
FIG. 14 is an end view of the handle shown in FIG. 13.
Figure 15:
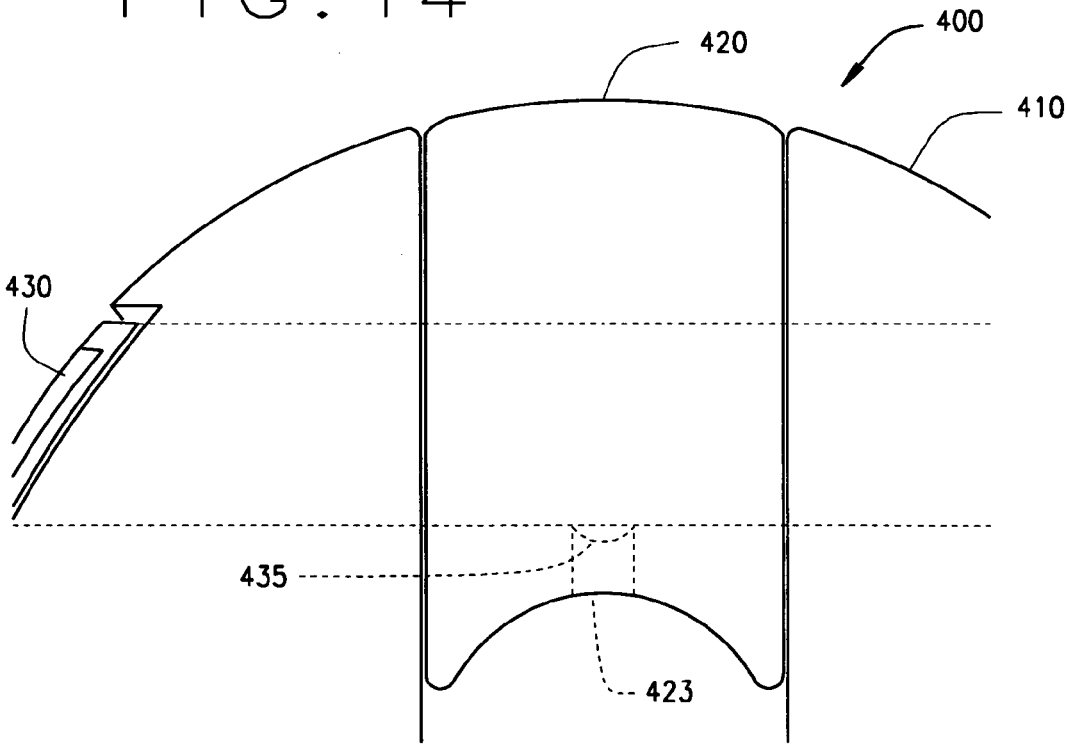
FIG. 15 is a partial end view of the handle shown in FIG. 13 illustrating the engagement of a catch within an opening.
Figure 16:
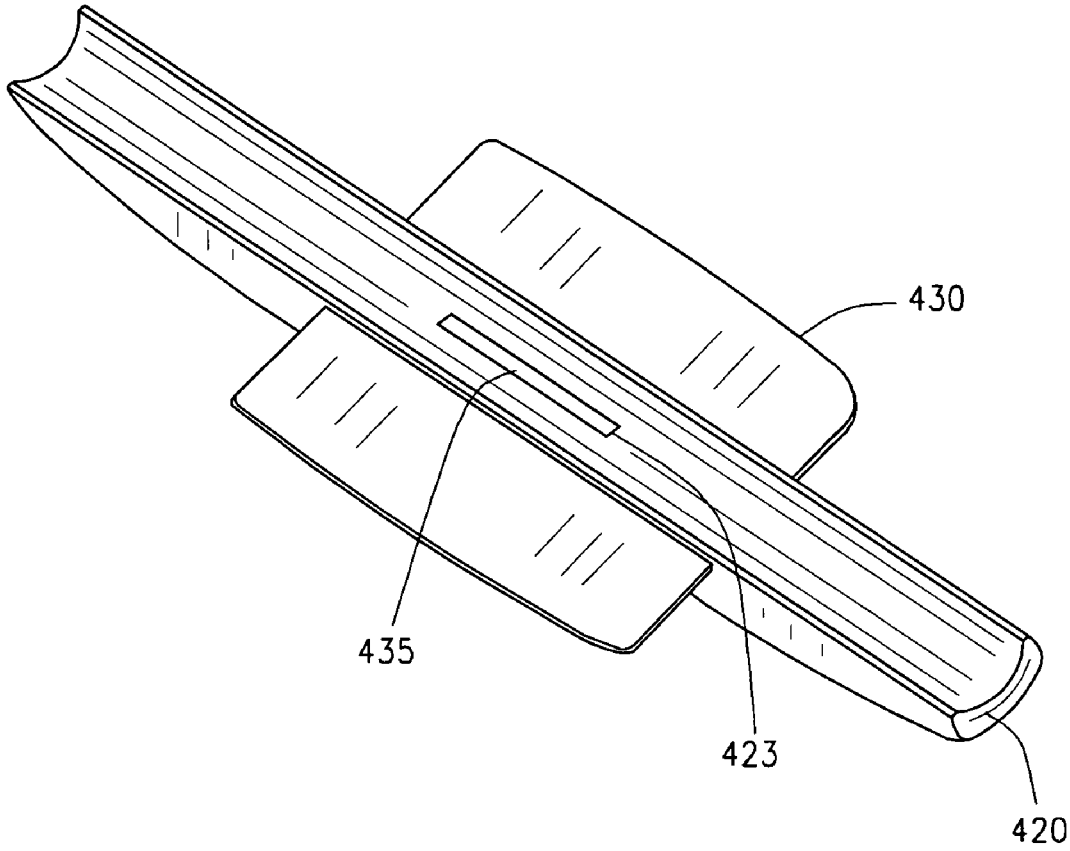
FIG. 16 is a perspective view of the handle shown in FIG. 13 with the handle body removed for clarity in order to illustrate the engagement of the key member with the retainer member.

In the particular illustrated embodiment of FIGS. 14 through 16, the key member 430 includes a rib or ridge 435, and the retaining member 420 includes an opening 423. The opening 423 extends from the retaining member's aperture 422 downwardly through the portion of the retaining member 420. The opening 423 is configured to engagingly receive the rib 435 when the key member 430 is engaged within the retaining member's aperture 422. Engagement of the rib 435 within the opening 423 inhibits the egress of the key member 430 from within the retaining member's aperture 422. Alternative embodiments include the key member having the catch, and the retaining member having the opening for engagingly receiving the catch. Further embodiments include the key member and retaining member having male and female catch features (e.g., ribs and openings, etc.), but which are located at different positions. Yet other embodiments do not include male and female catch features.

Figure 17:
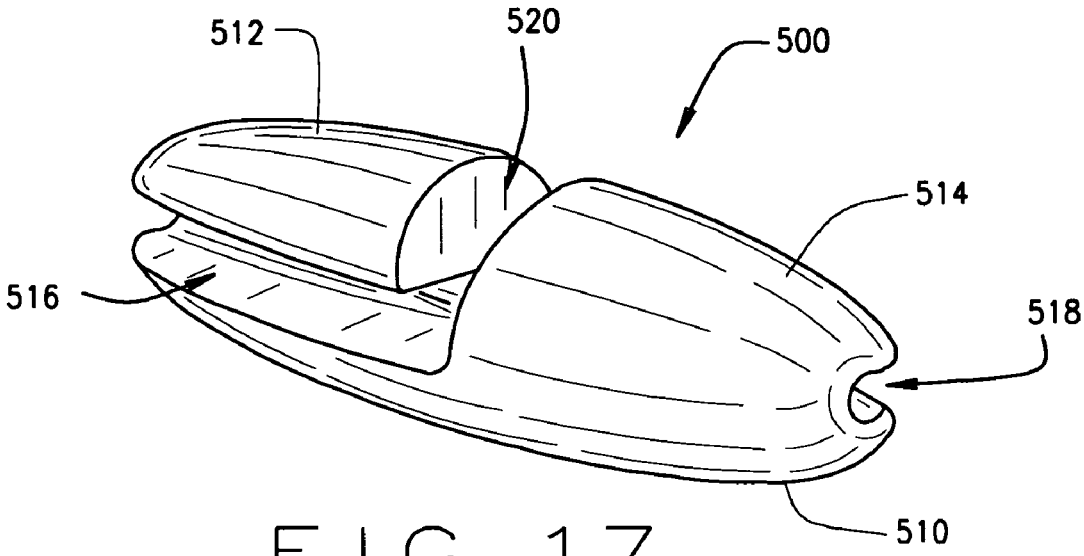
FIG. 17 is a perspective view of a one-piece handle that can be attached to a wire according to another exemplary embodiment of the invention.
Figure 18:
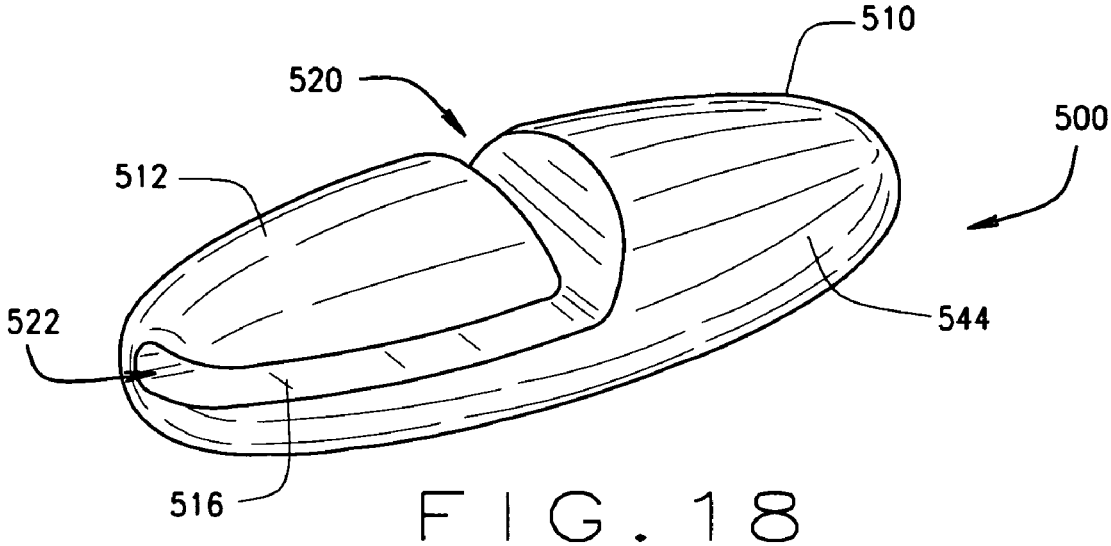
FIG. 18 is a perspective view of the other side of one-piece handle shown in FIG. 17.
Figure 19:
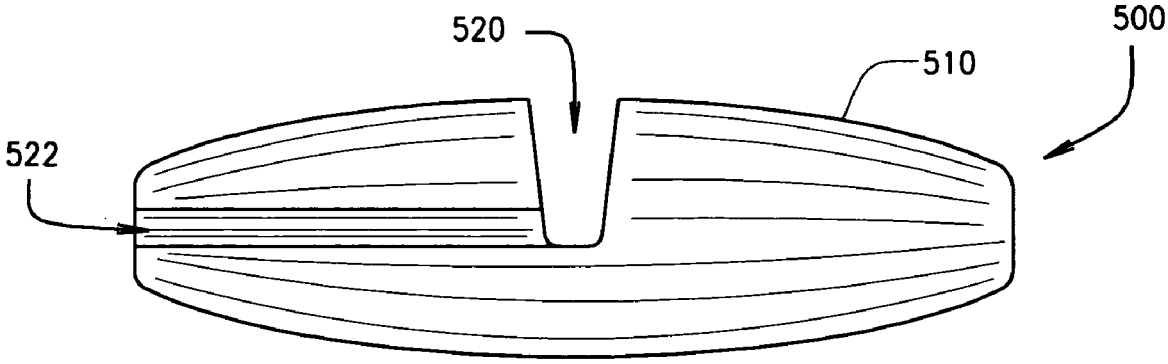
FIG. 19 is a side view of the one-piece handle shown in FIG. 17.
Figure 20:
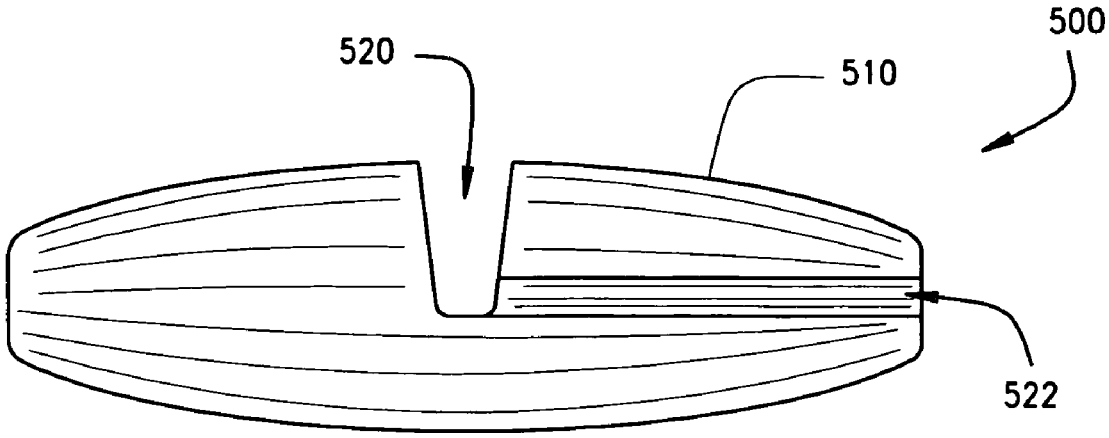
FIG. 20 is a side view of the one-piece handle shown in FIG. 18.
Figure 21:
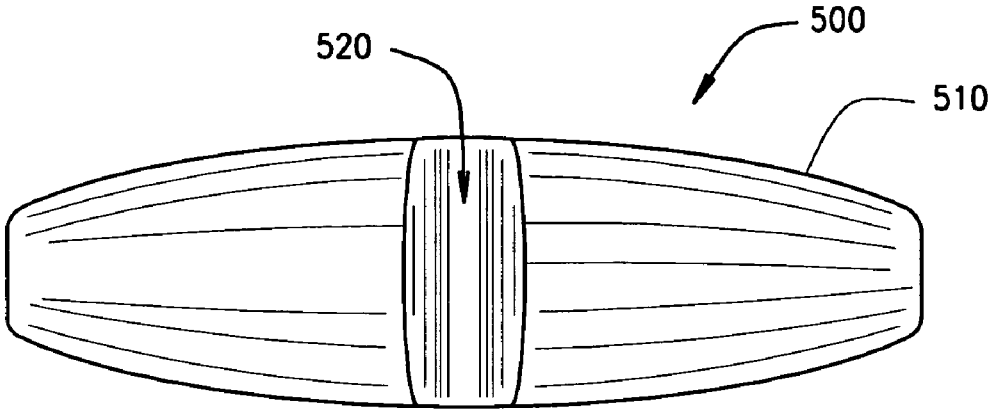
FIG. 21 is an upper view of the one-piece handle shown in FIG. 17.
Figure 22:
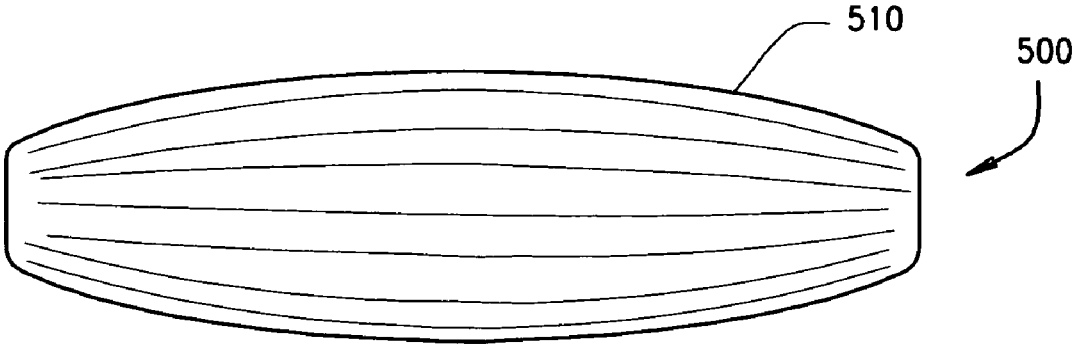
FIG. 22 is a lower view of the one-piece handle shown in FIG. 17.
Figure 23:
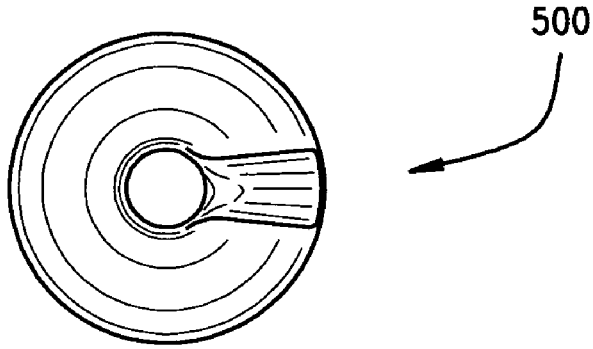
FIG. 23 is an end view of the one-piece handle shown in FIG. 17.

FIGS. 17 though 22 illustrate another embodiment of a handle 500. As shown, the handle 500 includes a handle body 510 having first and second end portions 512 and 514 with corresponding first and second slots 516 and 518 therein. The first slot 516 extends along the first end portion 512. The second slot 518 extends along the second end portion 514 on a side of the handle body 510 generally opposite that of the first slot 516.

The handle body 510 also includes a third slot 520 that substantially transversely intersects the first and second slots 516 and 518. The first slot 516, second slot 518 and third slot 520 define a longitudinal channel or passageway 522 through the handle body 510.

FIGS. 24 through 29 generally illustrate the one-piece handle 500 being assembled to a wire basket 600 according to another exemplary embodiment of the invention. The particular basket shown in FIGS. 24 through 29 is for purposes of illustration only as various aspects of the invention can be used with a wide range of wires, wire-like members, and devices having such wires or wire-like members, including wire ventilated shelves, bins, baskets, sliding storage devices (e.g., sliding shelves, trays, etc.), kitchen cabinetry, garage cabinetry, bathroom cabinetry, pots, pans, buckets, among other containers and storage devices. Accordingly, the specific references to wire basket herein should not be construed as limiting the scope of the invention to only one specific form/type of application. By way of example, one or more handles may be used in connection with a slide-type of installation in which the handles allow the user to more comfortably pull out the sliding device, such as in kitchen, garage, and/or bathroom cabinetry.

Figure 24:
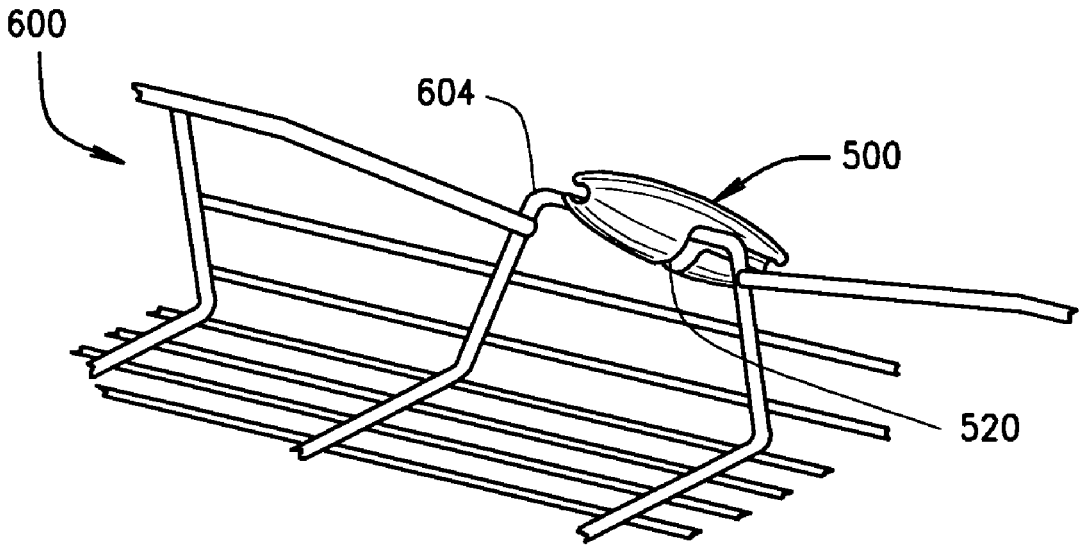
FIGS. 24 through 28 illustrate the one-piece handle shown in FIG. 17 being assembled to a wire basket according to another exemplary embodiment of the invention.
Figure 25:
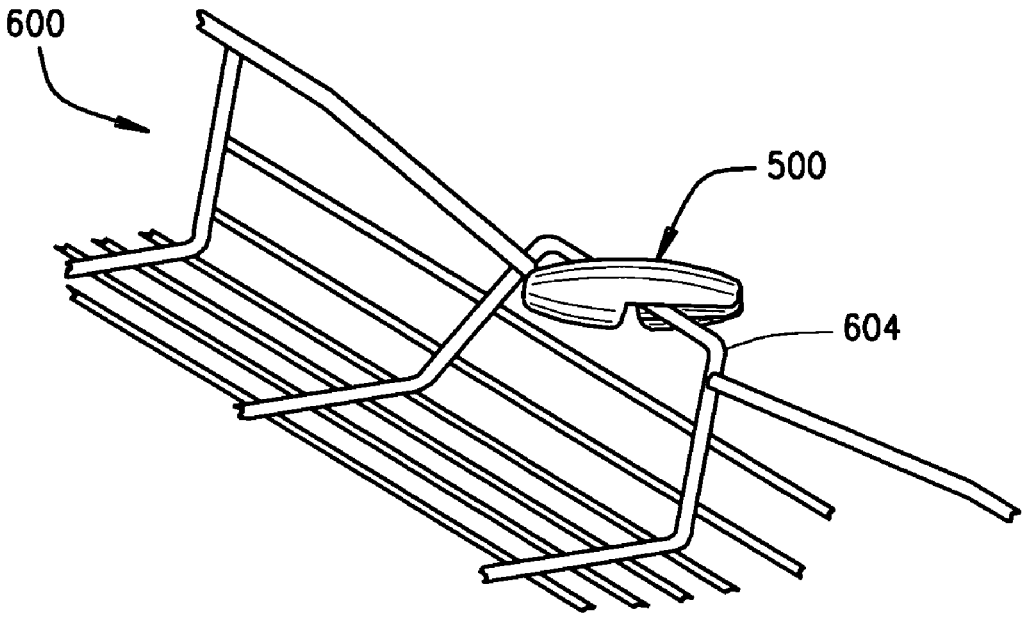
Figure 26:
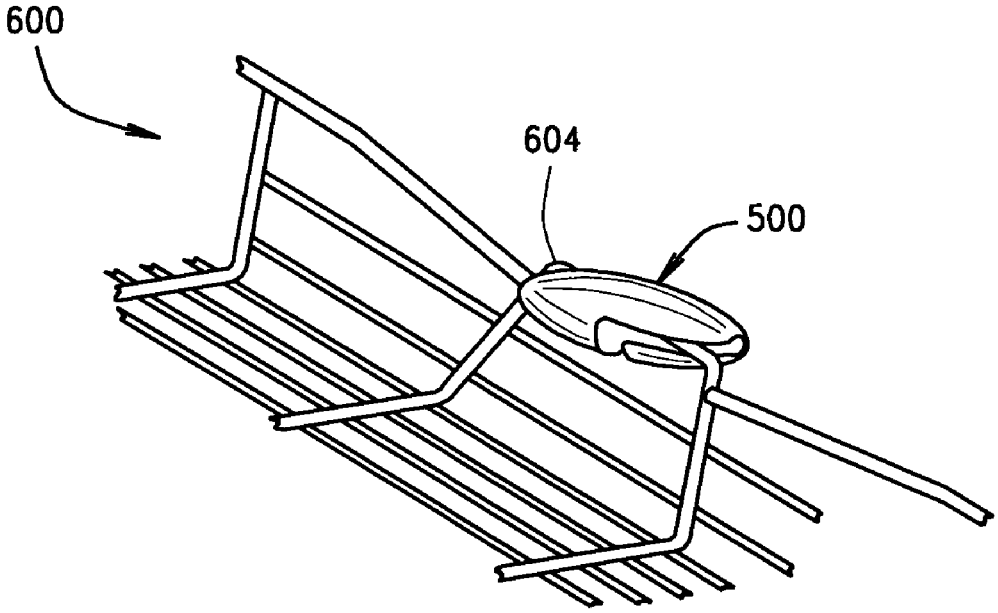
Figure 27:
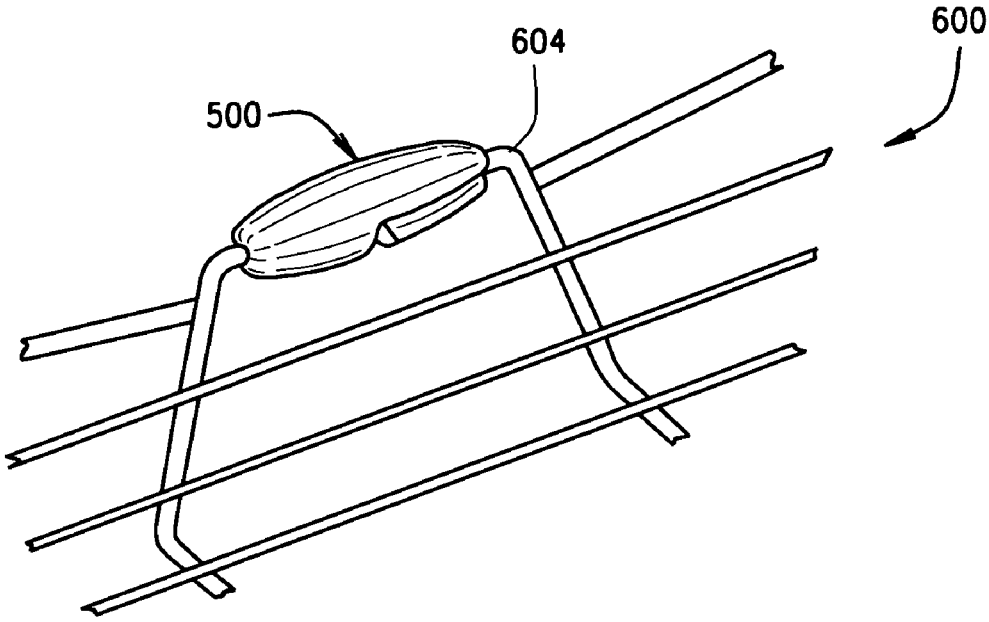
Figure 28:
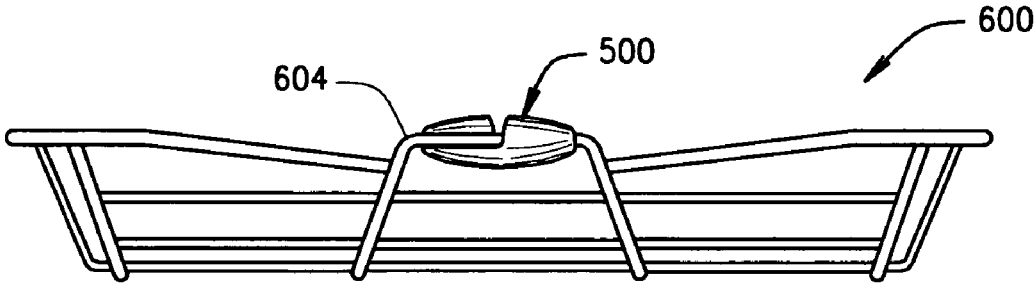
Figure 29:
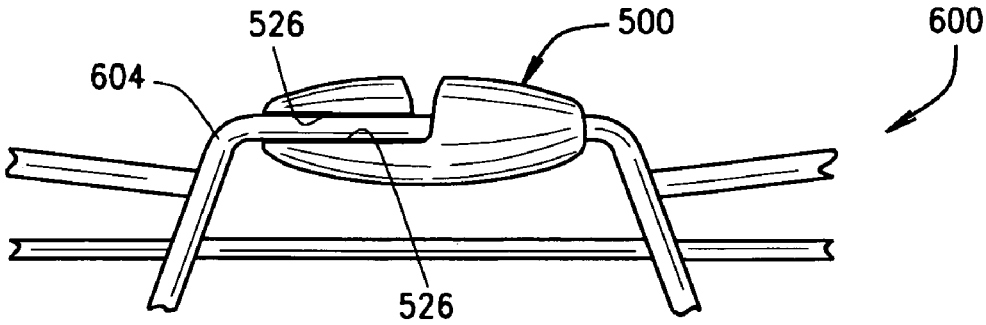
FIG. 29 is a partial side view of the one-piece handle shown in FIGS. 24 through 28 after the one-piece handle has been assembled to the wire basket.

An exemplary operation will now be described for attaching the handle 500 to a wire member. First, the handle 500 is positioned relative to a wire member such that a portion of the wire member 604 is received within the third slot 520. As shown in FIG. 24, the handle 500 is straddling the wire member 604 with the wire member 604 positioned within the lateral or third slot 520. As shown in FIGS. 25 through 29, the handle 500 with the wire member 604 received in the third slot 520 is then rotated relative to the wire member 604 about ninety degrees in a direction (e.g., clockwise in FIGS. 25 through 29) generally transverse to the longitudinal passage 522. This rotation repositions or moves the portion of the wire member 604 into the longitudinal passage 522 collectively defined by the first, second, and third slots 516, 518, 520, as shown in FIGS. 28 and 29.

As shown in FIG. 29, the handle may be snapped into position by way of one or more camming surfaces 526 adjacent or within the first and second slots 516 and 518. These camming surfaces 526 can be disposed over at least a portion of the wire to help retain the handle 500 to the wire. In various embodiments, the camming surface still allow the handle 500 to be readily but forcibly removed from the wire and then added to another product without the use of tools.

In various embodiments, one or more of the slots 516, 518, 520 may be configured to frictionally engage the wire member portion therein to inhibit rotation of the handle 500 relative to the wire member and thus inhibit the egress of the wire member from the longitudinal passage 522. By way of example only, one or more ribs may be provided within one or more of the slots 516, 518, 520 for frictionally engaging the wire portion within the passage 522. These ribs may be compressed as the wire is seated within the channel 522.

In various embodiments, the handle 500 can have an external appearance resembling a cigar and be about as wide as the average adult hand. A wide range of materials can be used for the handle 500. In various embodiments, the handle 500 is produced from plastics, composite materials, silicon, combinations thereof, etc. By way of example only, some particular embodiments include the handle 500 being made of a material that is very stable in temperature extremes, such as silicon. In such embodiments, the handle 500 can be effectively utilized as a grip for hot or cold items. Alternatively, other suitable materials can also be used for the handle 500. In some embodiments, the handle 500 is configured to resemble or to take on visual similarities to different materials, such as carbon fiber, metals, woods, etc.

Various aspects of the invention can be used with a wide range of wires, wire-like members, and devices having such wires or wire-like members, including wire ventilated shelves, bins, baskets, sliding storage devices (e.g., sliding shelves, trays, etc.), kitchen cabinetry, garage cabinetry, bathroom cabinetry, pots, pans, buckets, among other containers and storage devices. Accordingly, the specific references to wire and to wire basket herein should not be construed as limiting the scope of the invention to only one specific form/type of application. By way of example, one or more handles may be used in connection with a slide-type of installation in which the handles allow the user to more comfortably pull out the sliding device, such as in kitchen, garage, and/or bathroom cabinetry.

Further, the particular methods of manufacture and geometries disclosed herein are exemplary in nature and are not to be considered limiting. The steps, processes, and operations described herein are not to be construed as necessarily requiring their performance in the particular order discussed or illustrated, unless specifically identified as an order or performance. It is also to be understood that additional or alternative steps may be employed. In addition, any one or more aspects of the invention may be implemented individually or in any combination with any one or more of the other aspects of the invention.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A handle for attachment to a wire-like member, the handle comprising:

a handle portion having a channel, and an aperture extending from at least one outer surface of the handle portion into the channel, the channel configured to receive at least a portion of a wire-like member therein;

a retaining member configured to be received within the channel, the retaining member having an aperture; and a key member configured to be engaged within the handle portion's aperture and the retaining member's aperture, whereby the channel is configured to permit sidewalls of the channel to frictionally engage diametrically opposing sides of the wire-like member portion that is received within the channel without having to compress the retaining member against the wire-like member portion within the channel, and whereby engagement of the key member within the retaining member's aperture inhibits the egress of the retaining member from the channel to operatively trap at least a portion of a wire-like member within the channel, and, thereby, attach the handle portion to the wire-like member.

2. The handle of claim 1, wherein at least one of said retaining member and said key member includes at least one catch, and wherein the other of said retaining member and said key member includes at least one opening configured to engagingly receive the catch when the key member is engaged within the retaining member's aperture, whereby engagement of the catch within the opening inhibits the egress of the key member from within the retaining member's aperture.

3. The handle of claim 1, wherein the key member includes at least one rib, and wherein the retaining member includes at least one opening extending from the retaining member's aperture through at least a portion of the retaining member, the opening configured to engagingly receive the rib when the key member is engaged within the retaining member's aperture, whereby engagement of the rib within the opening inhibits the egress of the key member from within the retaining member's aperture.

4. The handle of claim 1, wherein the channel is disposed generally longitudinally along a length of the handle portion between opposite end portions of the handle portion.

5. The handle of claim 4, wherein the channel is configured such that at least a portion of the wire-like member to which the handle is attached is within the channel along a longitudinal centerline of the handle portion.

6. The handle of claim 1, wherein the handle portion's aperture is generally transverse to a longitudinal axis of the channel.

7. The handle of claim 1, wherein the handle portion's aperture extends completely through the handle portion.

8. The handle of claim 1, wherein the retaining member's aperture extends completely through the retaining member.

9. The handle of claim 1, wherein the key member is configured to snugly fit within the apertures of the handle portion and retaining member to thereby inhibit sliding movement of the retaining member relative to the channel.

10. The handle of claim 1, wherein the channel is configured with a spaced distance separating the channel's sidewalls such that the channel's sidewalls frictionally engage diametrically opposing sides of at least a portion of a wire-like member received therein.

11. The handle of claim 10, wherein the channel includes a lower surface, and wherein the channel's sidewalls and lower surface cooperatively define a generally U-shaped transverse profile.

12. The handle of claim 10, wherein the frictional engagement of the channel and the at least a portion of the wire-like member therein inhibits rotation of the handle portion relative to the wire-like member even prior to engaging the retaining member within the channel.

13. The handle of claim 1, wherein the handle portion includes an outer surface extending around at least about two hundred seventy degrees of the handle portion to thereby provide for a generally continuous integral handle grip without any seams.

14. The handle of claim 1, wherein the retaining member and the channel are configured to cooperatively define therebetween a passageway having a generally circular transverse profile for receiving at least a portion of a wire-like member having a corresponding generally circular transverse profile.

15. The handle of claim 1, wherein the retaining member's aperture is substantially aligned with the handle portion's aperture when the retaining member is engaged within the channel.

16. The handle of claim 15, when the retaining member's aperture aligns with the handle portion's aperture without having to compress the retaining member against at least a portion of a wire-like member within the channel.

17. The handle of claim 1, wherein the retaining member includes an outer surface that substantially aligns and cooperates with the handle portion's outer surface when the retaining member is engaged within the channel to thereby form a generally smooth outer surface for the handle.

18. A wire basket including a plurality of wires, and at least one handle of claim 1 attached to at least a portion of at least one of the wires.

19. The handle of claim 1, wherein the channel is configured to permit the channel's sidewalls to frictionally engage diametrically opposing sides of at least a portion of a wire member of a wire basket.

20. A handle for attachment to a wire member, the handle comprising:

a handle portion having a channel, and an aperture extending from at least one outer surface of the handle portion into the channel, the channel configured to receive at least a portion of a wire member therein, at least a portion of the channel having a width that frictionally engages diametrically opposing sides of the wire member received therein;

a retaining member configured to be received within the channel, the retaining member having an aperture therein; and a key member configured to be engaged within the handle portion's aperture and the retaining member's aperture, whereby engagement of the key member within the retaining member's aperture inhibits the egress of the retaining member from the channel to operatively trap at least a portion of a wire member within the channel, and, thereby, attach the handle portion to the wire member.

21. The handle of claim 20, wherein the retaining member includes a lower surface having a generally concave curvature, and wherein at least a lower portion of the channel includes a generally concave transverse profile such that the lower surface of the retaining member and the lower portion of the channel cooperatively define therebetween a passageway through the handle body portion having a generally circular transverse profile.

22. The handle of claim 20, wherein the channel includes first and second lip portions separated by a spaced distance thereby defining an opening into the channel, and wherein the handle portion includes an outer curved gripping surface that curves generally from the channel's first lip portion to the channel's second lip portion.

23. The handle of claim 22, wherein the retaining member includes an outer curved surface that substantially aligns and cooperates with the outer curved gripping surface of the handle portion when the retaining member is engaged within the channel to thereby form a curved gripping surface extending completely about the handle.

24. The handle of claim 20, wherein at least one of said retaining member and said key member includes at least one catch, and wherein the other of said retaining member and said key member includes at least one opening configured to engagingly receive the catch when the key member is engaged within the retaining member's aperture, whereby engagement of the catch within the opening inhibits the egress of the key member from within the retaining member's aperture.

25. A handle assembly for attachment to a wire basket having a plurality of wire members useful for carrying the wire basket, the handle assembly comprising:

a handle body having a channel disposed longitudinally along substantially the entire length of the handle body between opposite end portions of the handle body, and an opening therethrough and extending into the channel, the channel configured to receive at least a portion of one of said wire members of the wire basket substantially along a longitudinal centerline of the handle body;

a cap configured to be received within the channel, the cap having an aperture substantially transverse to the handle body's longitudinal centerline;

a key configured to be engaged within the handle body's opening and the cap's aperture, whereby engagement of the key within the cap's aperture inhibits the egress of the cap from the channel to operatively trap the portion of the wire member portion within the channel, and, thereby, attach the handle assembly to the wire basket;

wherein the cap includes a lower surface having a generally concave curvature, and wherein at least a lower portion of the channel includes a generally concave transverse profile such that the lower surface of the cap and the lower portion of the channel cooperatively define therebetween a passageway through the handle body having a generally circular transverse profile.

26. The handle assembly of claim 25, wherein the channel includes first and second lip portions separated by a spaced distance thereby defining an opening into the channel, and wherein the handle body includes an outer curved gripping surface that curves generally from the channel's first lip portion to the channel's second lip portion.

27. A handle assembly for attachment to a wire basket having a plurality of wire members useful for carrying the wire basket, the handle assembly comprising:

a handle body having a channel disposed longitudinally along substantially the entire length of the handle body between opposite end portions of the handle body, and an opening therethrough and extending into the channel, the channel configured to receive at least a portion of one of said wire members of the wire basket substantially along a longitudinal centerline of the handle body;

a cap configured to be received within the channel, the cap having an aperture substantially transverse to the handle body's longitudinal centerline;

a key configured to be engaged within the handle body's opening and the cap's aperture, whereby engagement of the key within the cap's aperture inhibits the egress of the cap from the channel to operatively trap the portion of the wire member portion within the channel, and, thereby, attach the handle assembly to the wire basket;

wherein the channel includes first and second lip portions separated by a spaced distance thereby defining an opening into the channel, and wherein the handle body includes an outer curved gripping surface that curves generally from the channel's first lip portion to the channel's second lip portion;

wherein the cap includes an outer curved surface that substantially aligns and cooperates with the outer curved gripping surface of the handle body when the cap is engaged within the channel to thereby form a curved gripping surface extending completely about the periphery of the handle assembly.

28. A handle assembly for attachment to a wire basket having a plurality of wire members useful for carrying the wire basket, the handle assembly comprising:

a handle body having a channel disposed longitudinally along substantially the entire length of the handle body between opposite end portions of the handle body, and an opening therethrough and extending into the channel, the channel configured to receive at least a portion of one of said wire members of the wire basket substantially along a longitudinal centerline of the handle body;

a cap configured to be received within the channel, the cap having an aperture substantially transverse to the handle body's longitudinal centerline;

a key configured to be engaged within the handle body's opening and the cap's aperture, whereby engagement of the key within the cap's aperture inhibits the egress of the cap from the channel to operatively trap the portion of the wire member portion within the channel, and, thereby, attach the handle assembly to the wire basket;

wherein at least one of said cap and said key includes at least one catch, and wherein the other of said cap and said key includes at least one opening configured to engagingly receive the catch when the key is engaged within the cap's aperture, whereby engagement of the catch within the opening inhibits the egress of the key from within the cap's aperture.

* * * * *